US008544676B2

(12) United States Patent
Roth et al.

(10) Patent No.: US 8,544,676 B2
(45) Date of Patent: Oct. 1, 2013

(54) SYSTEM FOR USE WITH A CONSUMABLE BEVERAGE

(75) Inventors: Donna Roth, Plymouth, MA (US); Henry Roth, Plymouth, MA (US)

(73) Assignee: Cool Gear International, LLC, Plymouth, MA (US)

( * ) Notice: Subject to any disclaimer, the term of this patent is extended or adjusted under 35 U.S.C. 154(b) by 1092 days.

(21) Appl. No.: 12/061,689

(22) Filed: Apr. 3, 2008

(65) Prior Publication Data

US 2009/0250478 A1 Oct. 8, 2009

(51) Int. Cl.
*B65D 39/00* (2006.01)

(52) U.S. Cl.
USPC ..... 220/709; 220/592.16; 220/592.17; 220/703; 220/705; 220/707; 220/708; 220/752; 215/229; 215/388; 62/457.3

(58) Field of Classification Search
USPC ..... 220/592.16, 592.17, 705, 707, 708, 220/709, 752; 215/229; 62/457.3
See application file for complete search history.

(56) References Cited

U.S. PATENT DOCUMENTS 5,518,142 A * 5/1996 Lin ..... 220/707
5,590,542 A * 1/1997 Wang ..... 62/457.3
2005/0040175 A1* 2/2005 Stephens ..... 220/705

* cited by examiner

*Primary Examiner* — Anthony Stashick
*Assistant Examiner* — Elizabeth Volz
(74) *Attorney, Agent, or Firm* — Edwards Wildman Palmer LLP; Brian R. Landry; Alicia J. Esposito

(57) ABSTRACT

One aspect of the invention provides a system including a container defining a chamber for holding a beverage, a lid for engaging the container, a drinking straw located on the lid, and a fluid router detachable from the lid to facilitate the withdrawal of the beverage from the container. The fluid router includes a base adapted for placement in the proximity to an opening of the container, and a conduit having a first and a second ends disposed on the base. The fluid router can further include a connector disposed on the base and adapted to engage a thermal energy storage member located in the chamber. The first conduit end is adapted to engage the drinking straw. The system can further include a second straw engaged with the second conduit end and positioned in the chamber.

31 Claims, 5 Drawing Sheets

FIG. 3
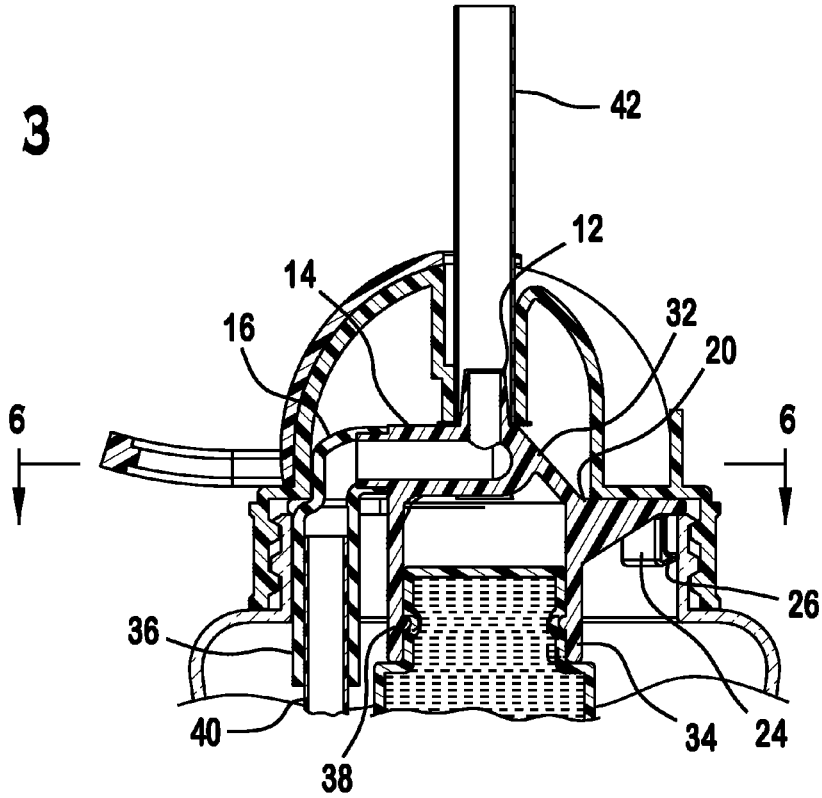
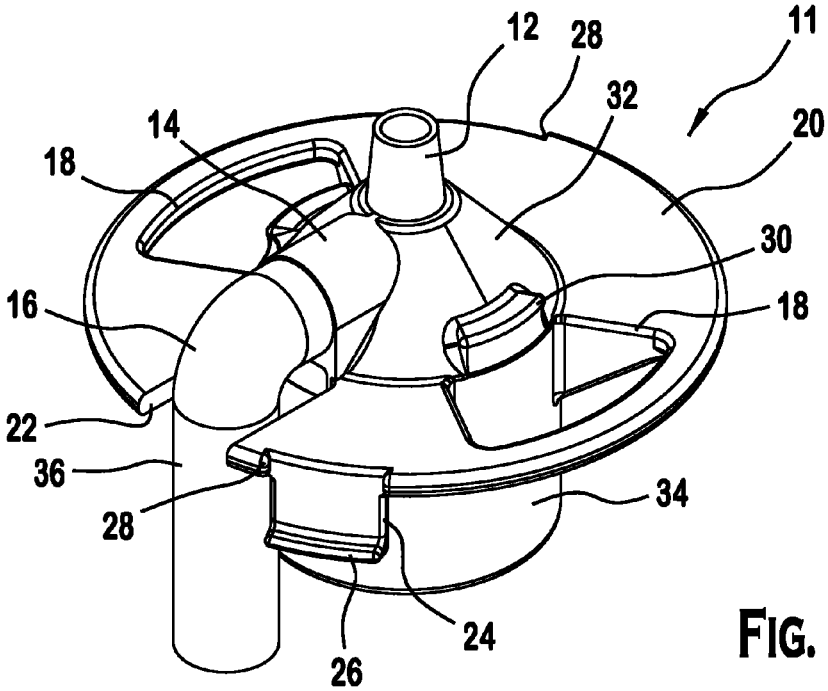
FIG. 4

FIG. 5
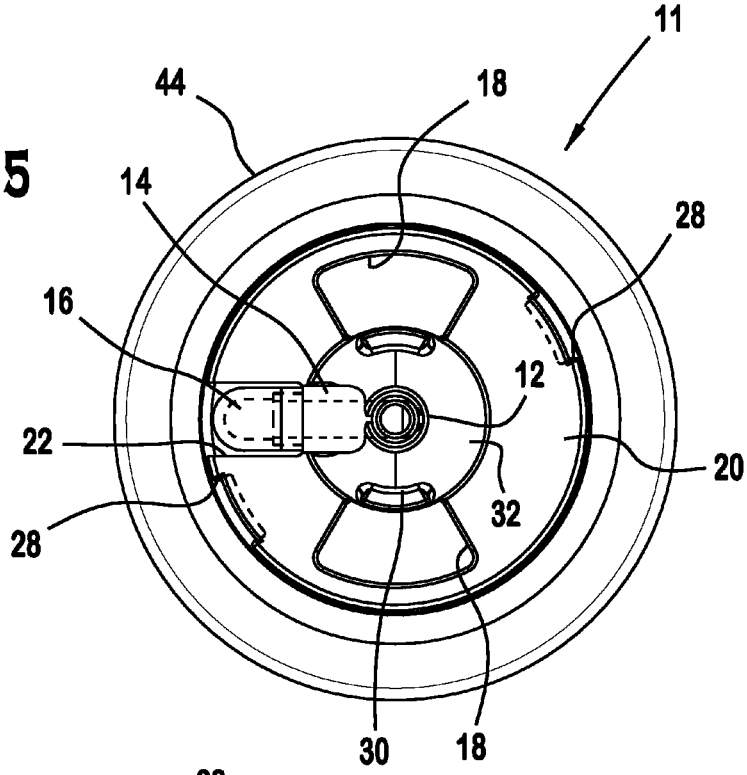
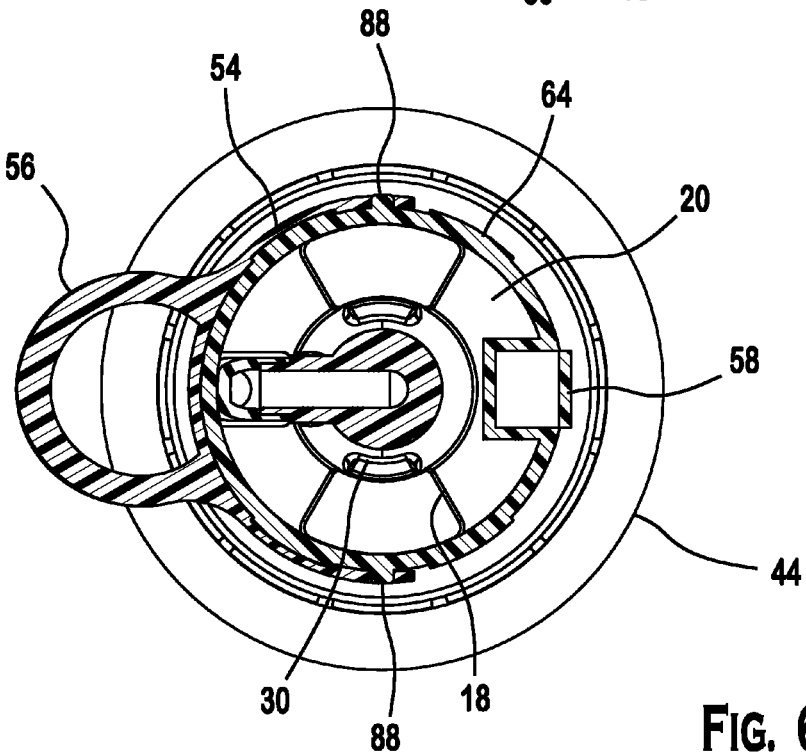
FIG. 6

SYSTEM FOR USE WITH A CONSUMABLE BEVERAGE

BACKGROUND

The present invention is generally directed to beverage containers and, more specifically, to containers that include fluid routers to facilitate the consumption of the beverage.

Conventional beverage containers are meant for use with a single straw that must extend through a generally linear path from the lid to the bottom of the drink container.

It may be advantageous to provide a system for a consumable beverage that is preferably adapted to allow the fluid flow path to be varied while still using a generally linear drinking straw.

SUMMARY

Briefly speaking, one embodiment of the present invention is directed to a system for use with a consumable beverage including a container defining a chamber adapted to hold the consumable beverage. The container has an opening. A lid is adapted for engaging the container. A drinking straw is located on the lid. A fluid router includes a base adapted for placement over and/or in the opening of the container. A conduit is disposed on the base and has first and second conduit ends. The first conduit end has a first opening adapted to face generally away from the container when the fluid router is engaged with the container. The second conduit end has a second opening adapted to face the chamber when the fluid router is engaged with the container. A connector is disposed on the base and is adapted to engage a thermal energy storage member located in the chamber. The first conduit end is adapted to engage the drinking straw so that at least some of the consumable beverage can flow from the chamber, through the conduit, and through the drinking straw to exit the container.

In a separate aspect, the present invention is directed to a system for use with a consumable beverage including a container defining a chamber adapted to hold the consumable beverage. The container has an opening. A lid is adapted for engaging the container. A drinking straw is located on the lid. A fluid router includes a base adapted for placement over and/or in the opening of the container. A conduit is disposed on the base and has first and second conduit ends. The first conduit end has a first opening adapted to face generally away from the container when the fluid router is engaged with the container. The second conduit end has a second opening adapted to face the chamber when the fluid router is engaged with the container. A connector is disposed on the base and is adapted to engage a thermal energy storage member located in the chamber. A second straw is engaged with the second conduit end and is positioned within the chamber. The first conduit end is adapted to engage the drinking straw so that at least some of the consumable beverage can flow from the chamber, through the second straw, through the conduit, and through the drinking straw to exit the container. The fluid router is configured such that a portion of the drinking straw that engages the first conduit end is adapted to be axially aligned with the thermal energy storage member engaged with the connector. The fluid router and the second straw combining to allow the drinking straw to draw consumable beverage from proximate a bottom of the chamber while being linearly aligned with the thermal energy storage member.

In a separate aspect, the present invention is directed to a system for use with a consumable beverage including a container defining a chamber adapted to hold the consumable beverage. The container has an opening. A lid is adapted for engaging the container. A drinking straw is located on the lid. A thermal energy storage member is located in the chamber and is adapted to head and/or cool the consumable beverage in the chamber. A fluid router includes a base adapted for placement over and/or in the opening of the container. A conduit is disposed on the base and has first and second conduit ends. The first conduit end has a first opening adapted to face generally away from the container when the fluid router is engaged with the container. The second conduit end has a second opening adapted to face the chamber when the fluid router is engaged with the container. A plurality of tabs depend from the base and are adapted to extend into the container when the base is engaged with the container. The tabs include a rib extending generally outwardly therefrom and are adapted to abut an inner surface of the container. The tabs are configured to abut an inner surface of the container to facilitate the proper alignment of the fluid router while the fluid router is engaged with the container. A connector is disposed on the base and is adapted to engage the thermal energy storage member located in the chamber. The first conduit end is adapted to engage the drinking straw so that at least some of the consumable beverage can flow from the chamber, through the conduit, and through the drinking straw to exit the container.

In a separate aspect, the present invention is directed to a system for use with a consumable beverage including a container defining a chamber adapted to hold the consumable beverage. The container has an opening. A lid is adapted for engaging the container. A drinking straw is located on the lid. A fluid router includes a base adapted for placement over and/or in the opening of the container. A conduit is disposed on the base and has first and second conduit ends. The first conduit end has a first opening adapted to face generally away from the container when the fluid router is engaged with the container. The second conduit end has a second opening adapted to face the chamber when the fluid router is engaged with the container. The first conduit end is adapted to engage the drinking straw so that at least some of the consumable beverage can flow from the chamber, through the conduit, and through the drinking straw to exit the container.

BRIEF DESCRIPTION OF THE DRAWINGS

The foregoing summary, as well as the following description of the preferred embodiment of the present invention, will be better understood when read in conjunction with the appended drawings. For the purpose of illustrating the invention, there is shown in the drawings an embodiment which are presently preferred. It is understood, however, that the invention is not limited to the precise arrangement and instrumentality shown. In the drawings:

FIG. 3 is a partial cross-sectional view of the system of FIG. 1;

FIG. 4 is an enlarged perspective view of the fluid router of FIG. 2;

FIG. 5 is a top plan view of the system of FIG. 1 with the lid and drinking straw removed;

FIG. 6 is cross sectional view of the system of FIG. 3 as taken along the line 6-6 in FIG. 3;

DETAILED DESCRIPTION OF THE PREFERRED EMBODIMENTS

Figure 1:
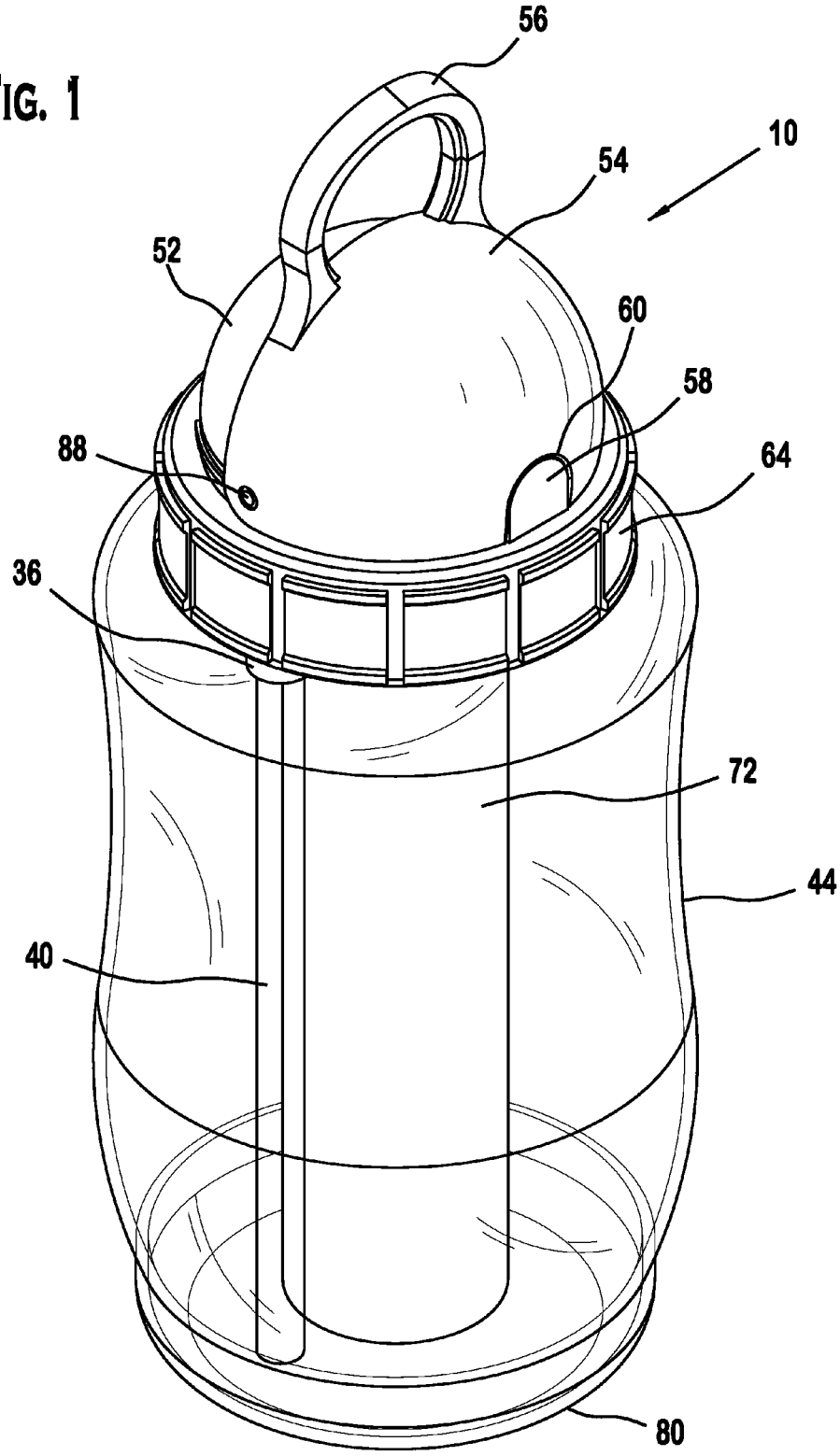
FIG. 1 is a perspective view of a preferred embodiment of a system for use with a consumable beverage according to the present invention.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the system for use with a consumable beverage and designated parts thereof. The words "a" and "one" are defined as including one or more of the referenced item unless specifically stated otherwise. This terminology includes the words above specifically mentioned, derivatives thereof, and words of similar import.

Referring to FIGS. 1-8, wherein like numerals indicate like elements throughout, a preferred embodiment of a system for use with a consumable beverage is shown and designated 10. Briefly stated, system 10 allows a thermal energy storage member 72 to be centrally held in a container 44 while still allowing a centrally located drinking straw 42 to draw consumable beverage from a chamber 48 within the container 44.

The lid 50, the container 44, and the fluid router 11, are preferably made of a polymeric material, such as polyethylene, polyethylene terephthalate (PET), polyvinyl chloride (PVC), or polyphthalate carbonate (PPC). However, any other suitable material can be used without departing from the scope of the present invention.

Figure 2:
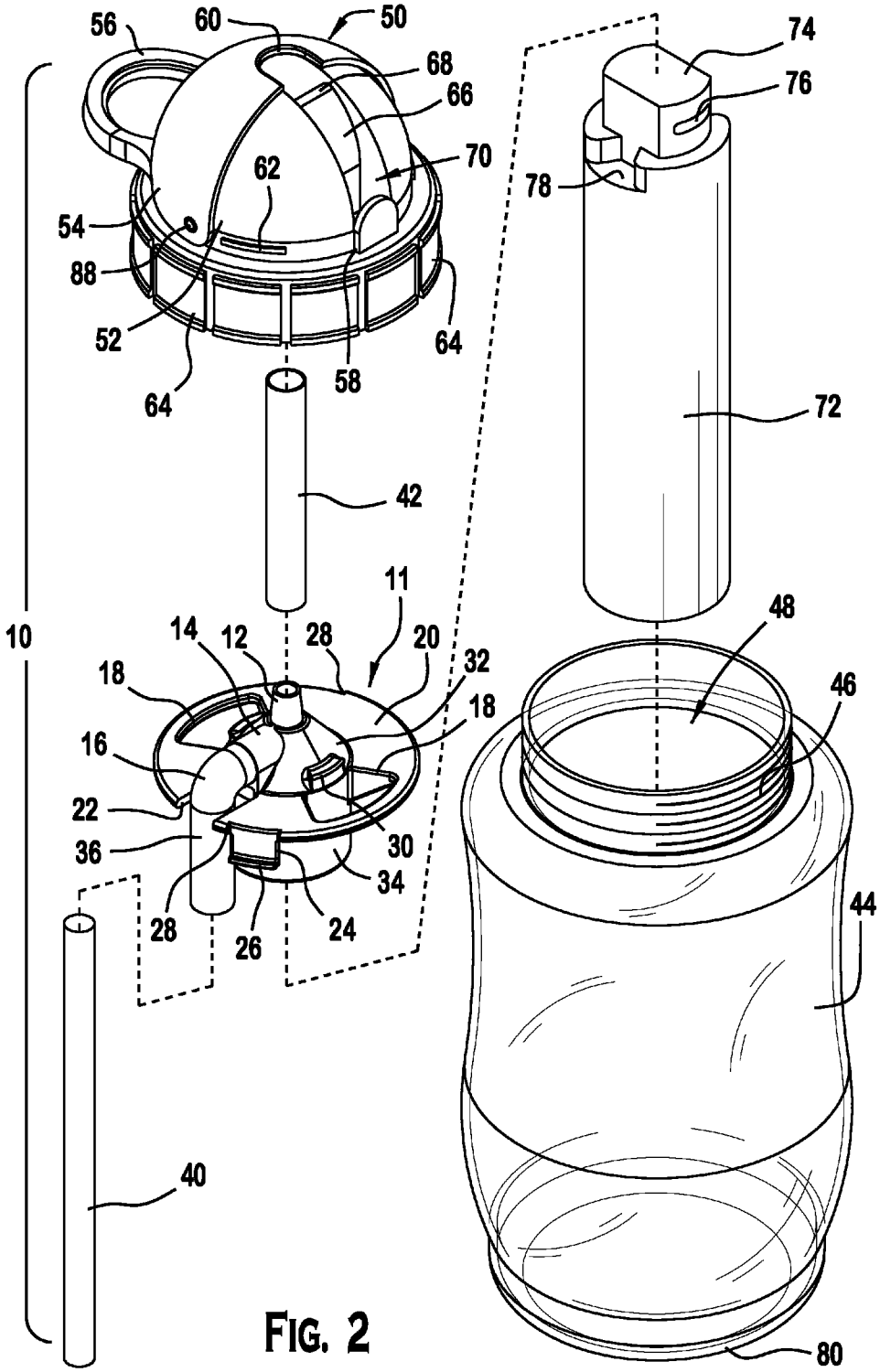
FIG. 2 is an exploded view of the system of FIG. 1.

Referring to FIGS. 1 and 2, the system 10 for use with a consumable beverage includes a container 44 that defines a chamber 48 adapted to hold consumable beverage. The container 44 is preferably designed to hold a single consumable, but may be configured to hold multiple consumables in various chambers 48.

The container 44 has an opening 48. The opening 48 is preferably circular. The top of the container may include at least one thread 46. A lid 50 is adapted for engaging the container 44. The lid 50 is preferably generally hemispherical and comprises a shield 54 moveable between a first position (shown in FIGS. 2 and 3), in which the drinking straw 42 extends from the lid 50 and is configured for drinking, and a second position (shown in FIG. 1), in which the straw 42 is at least partially compressed and is contained within a cavity 70 in the lid 50 so as not to protrude from the lid 50.

A hemispherical lid surface 52 defines the cavity 70 which can house the straw 42 when the shield 54 is in the second position. When the shield 54 is moving into the second position, the shield 54 bends the straw 42 about an apex 68 and along a bending surface 66. At least one ridge 62 may be located on the hemispherical surface 52 to engage the shield 50 to provide resistance against the shield 50 moving out of the second position.

The shield 50 preferably defines a generally semicircular notch 60 therein. A complementary guide 58 is positioned on a lower portion of the lid 50. The guide 58 aids in the proper rotation of the shield 50 into the closed, second position as it rotates around pin 88.

The lid 50 further comprises ridges 62 to provide resistance to the shield 50 being rotated out of the second position. The lid 50 may include a handle 56 positioned on the shield 50 such that the container 44 depends from the handle 56 and is generally linearly aligned with a plane defined by the handle 56 when the shield 50 is in the second position. Grip material 64 may be positioned along a lower edge of the lid 50 to facilitate engaging the lid 50 with the container 44.

A drinking straw 42 is preferably located on the lid 50 and extends therethrough. The drinking straw is preferably polymeric and has a circular cross-section as taken parallel to a longitudinal axis. Referring to FIG. 3 it is preferred that the drinking straw 42 extend through the hemispherical portion 52 of the lid when the lid 50 is in the first, open position.

As best shown in FIGS. 3 and 4, a fluid router 11 includes a base 20 adapted for placement over and/or in the opening 48 of the container 44. The base 20 is preferably generally circular. However, those of ordinary skill in the art will appreciate from this disclosure that the base can have any desired shape without departing from the scope of the present invention. A plurality of cutouts 18 may extend through the base 20. The exemplary cutouts are generally trapezoidal and occupy a larger circumferential path as they extend radially outwardly. While two cutouts 18 are shown, any number of cutouts 18 can be used with the fluid router 11. One benefit of the cutouts 18 is that they allow consumable beverage to flow past the fluid router 11 when the bottle is tilted to avoid placing increased pressure on the fluid router 11.

A conduit 18 is preferably disposed on the base 20 and has first and second conduit ends 12, 36. It is preferred, but not necessary, that the conduit extend through first and second bends 16 such that the drinking straw 42 and a second straw 40 define axes that are generally parallel to each other. The bends 16 preferably extend through an angle of between approximately sixty (60) degrees and one hundred fifty (150) degrees. It is more preferred that the bends extend through an angle of between approximately eighty (80) degrees and one hundred (100) degrees. It is more preferred still that the bends 16 extend through an approximately ninety (90) degree turn.

As best shown in FIG. 4, the upper portion of the fluid router may have a sloping section 32. Portions of the outer surface of the sloping section 32 may protrude outwardly to form lips 30. The first conduit end 12 is preferably located proximate to the sloping section 32 is generally conically shaped and terminates in a generally circular opening positioned to engage the drinking straw 42. As shown in FIG. 3, it is preferred that the drinking straw 42 is oriented substantially coaxially with the first conduit end 12 when the shield 54 is in the first position.

The first conduit end 12 preferably has the a first opening configured/adapted to face generally away from the container 44 when the fluid router 11 is engaged with the container 44. The conduit 14 preferably extends generally laterally/radially from the sloping section 32 near the top of the fluid router and then goes through a bend 16 and continues to extend downwardly through the base 20. The second conduit end 36 preferably has a second opening adapted to face the chamber 44 when the fluid router 11 is engaged with the container 44. The conduit may pass through a notch 22 in the base that is generally oblong in shape.

Figure 7:
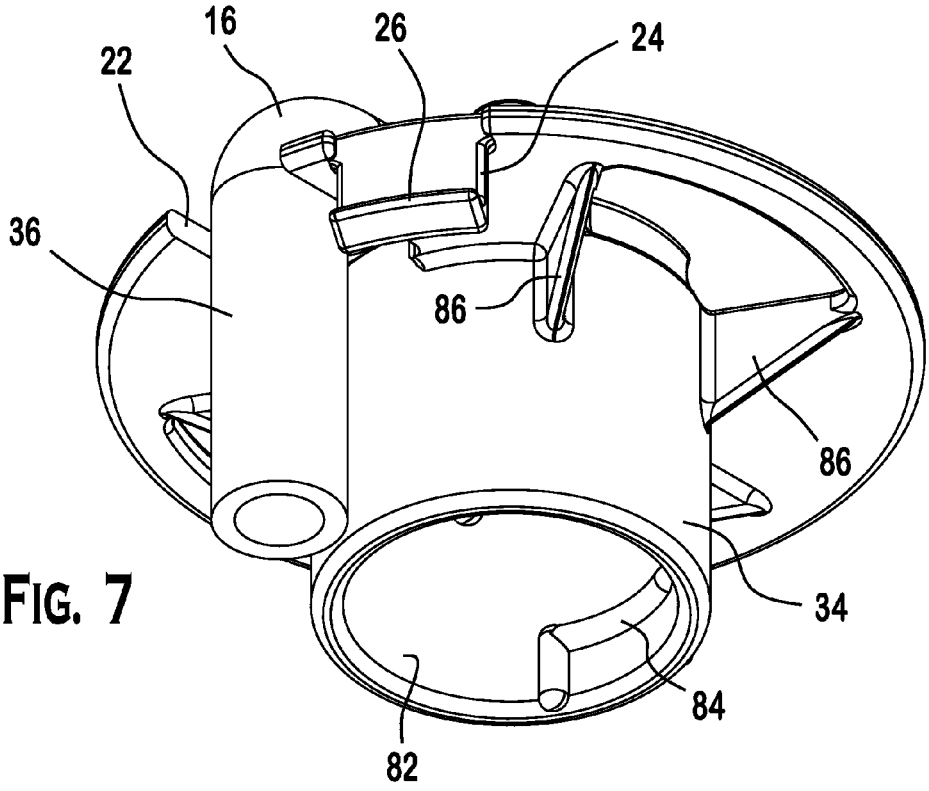
FIG. 7 is an enlarged second perspective view of the fluid router of FIG. 4.

The fluid router 11 may be configured such that a portion of the drinking straw 42 that engages the first conduit end 12 is adapted to be axially aligned with a thermal energy storage member 72 (further described below) engaged with a connector 34. Referring to FIGS. 3 and 7, the connector 34 is preferably annular in cross section and has an inner surface 82 with a thread or other projection located thereon. While one preferred configuration of the fluid router has been described, those of ordinary skill in the art will appreciate from this disclosure that any suitable structure or configuration can be used without departing from the scope of the present invention.

The fluid router 11 and second straw 40 may combine to allow the drinking straw 42 to draw consumable beverage from proximate a bottom 80 of the chamber 48 while being linearly aligned with the thermal energy storage member 72.

The thermal energy storage member 72 preferably maintains the consumable beverage in either a chilled or heated condition. The thermal energy storage member 72 is preferably securable to the connector 34 via a convenient twist lock feature that allows the thermal energy storage member 72 to be easily disengaged therefrom. The system 10 can be used with one of multiple interchangeable thermal energy storage members 72, to avoid delays caused by waiting for a single thermal energy storage member 72 to re-freeze or re-heat prior to continued use of the system 10.

The thermal energy storage member 72 preferably contains a gelatinous material that is formed of re-freezable material and/or re-heatable material, such as the non-toxic materials used in gel packs and the like. However, any suitable thermal material can be used without departing from the scope of the present invention. The connector 34 is preferably disposed on the bottom of base 20 and is adapted to engage the thermal energy storage member 72 which is locatable in the chamber 48.

It is preferred that the top 74 of the thermal energy storage member include a channel 76 therein adapted to mate with a thread 84, 38 in the connector 34. A groove 78 is also preferably located proximate the top 72 of the thermal energy storage member 72. While one preferred configuration of the thermal energy storage member 72 has been described, those of ordinary skill in the art will appreciate from this disclosure that any suitable structure or configuration can be used without departing from the scope of the present invention.

The first conduit end 12 is preferably adapted to engage the drinking straw 42 so that at least some of the consumable beverage can flow from the chamber 48, (possibly through the second straw 40) through the conduit 14, and through the drinking straw 42 to exit the container. The second straw 40 may be engaged with the second conduit end 36 and may be positioned within the chamber 48. Alternatively, the second conduit end 36 could be of longer length to essentially integrate the function of the second straw 40 into the fluid router 11 without departing from the scope of the present invention.

Figure 8:
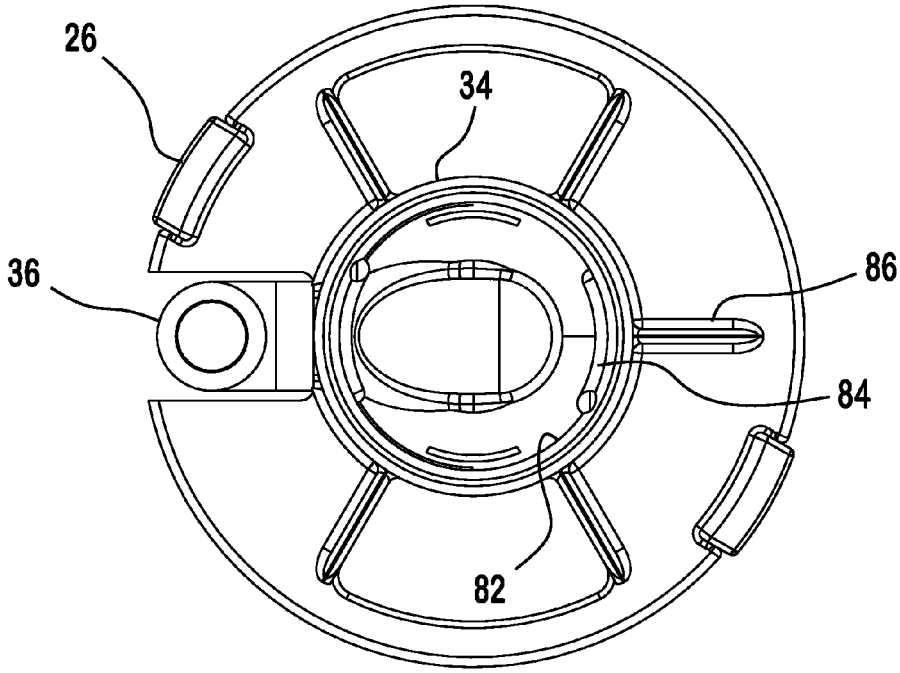
FIG. 8 is bottom plan view of the fluid router of FIG. 4.

Referring to FIGS. 7 and 8, a plurality of tabs 24 may depend from the base 20 and may be adapted to extend into the container 44 when the base 20 is engaged with the container 44. The tabs 24 preferably include a rib 26 extending generally outwardly therefrom that may be adapted to abut an inner surface of the container 44. The plurality of tabs 24 can be configured to abut an inner surface of the container 44 to facilitate the proper alignment of the fluid router 11 while the fluid router 11 is engaged with the container 44. Tabs 24 can be formed within cutouts 28.

While various shapes, configurations, uses, and features have been described above and are shown in the drawings for the various embodiments of the present invention, those of ordinary skill in the art will appreciate from this disclosure that any combination of the above features can be used without departing from the scope of the present invention. Accordingly, it is recognized by those skilled in the art that changes may be made to the above described embodiments of the invention without departing from the broad inventive concept thereof. It is understood, therefore, that this invention is not limited to the particular embodiments disclosed, but it is intended to cover all modifications which are within the spirit and scope of the invention as defined by the appended claims and/or shown in the attached drawings.

What is claimed is:

1. A system for use with a consumable beverage, comprising:

a container defining a chamber adapted to hold the consumable beverage, the container having an opening;

a lid adapted for engaging the container;

a drinking straw located on the lid;

a fluid router detachable from the lid, the fluid router comprising:

a base adapted for placement over and/or in the opening of the container;

a conduit disposed on the base and having first and second conduit ends, the first conduit end having a first opening adapted to face generally away from the container when the fluid router is engaged with the container, the second conduit end having a second opening adapted to face the chamber when the fluid router is engaged with the container; and a connector disposed on the base and adapted to engage a thermal energy storage member located in the chamber.

2. The system of claim 1, wherein a plurality of cutouts extend through the base.

3. The system of claim 1, wherein the first conduit end is generally conically shaped.

4. The system of claim 1, wherein the first conduit end is adapted to detachably engage the drinking straw so that at least some of the consumable beverage can flow from the chamber, through the conduit, and through the drinking straw to exit the container.

5. The system of claim 1, further comprising a plurality of tabs depending from the base and adapted to extend into the container when the base is engaged with the container.

6. The system of claim 5, wherein the tabs further comprise a rib extending generally outwardly therefrom and adapted to abut an inner surface of the container.

7. The system of claim 6, wherein the plurality of tabs are configured to abut an inner surface of the container to facilitate the proper alignment of the fluid router while the fluid router is engaged with the container.

8. The system of claim 1, wherein the lid is generally hemispherical and comprises a shield moveable between a first position, in which the drinking straw extends from the lid and is configured for drinking, and a second position, in which the straw is at least partially compressed and is contained within a cavity in the lid so as not to protrude from the lid.

9. The system of claim 8, wherein the lid further comprises ridges to provide resistance to the shield being rotated out of the second position.

10. The system of claim 9, wherein the lid further comprises a handle positioned on the shield such that the bottle depends from the handle and is generally linearly aligned with a plane defined by the handle when the shield is in the second position.

11. The system of claim 1, further comprising a second straw engaged with the second conduit end and positioned within the chamber.

12. The system of claim 11, wherein the fluid router is configured such that a portion of the drinking straw that engages the first conduit end is adapted to be axially aligned with the thermal energy storage member engaged with the connector, the fluid router and second straw combining to allow the drinking straw to draw consumable beverage from proximate a bottom of the chamber while being linearly aligned with the thermal energy storage member.

13. The system of claim 12, wherein the conduit is configured to extend through first and second bends such that the drinking straw and the second straw define axes that are generally parallel, wherein the first and second bends are of between about sixty (60) degrees and about one hundred fifty (150) degrees.

14. The system of claim 13, wherein the first and second bends are between about eighty (80) degrees and about one hundred (100) degrees.

15. The system of claim 13, wherein the first and second bends are of about ninety (90) degrees.

16. A system for use with a consumable beverage, comprising:

a container defining a chamber adapted to hold the consumable beverage, the container having an opening;

a lid adapted for engaging the container;

a drinking straw located on the lid;

a fluid router detachable from the lid, the fluid router comprising:

a base adapted for placement over and/or in the opening of the container;

a conduit disposed on the base and having first and second conduit ends, the first conduit end having a first opening adapted to face generally away from the container when the fluid router is engaged with the container, the second conduit end having a second opening adapted to face the chamber when the fluid router is engaged with the container;

a connector disposed on the base and adapted to engage a thermal energy storage member located in the chamber; and a second straw engaged with the second conduit end and positioned within the chamber;

wherein the first conduit end is adapted to engage the drinking straw so that at least some of the consumable beverage can flow from the chamber, through the second straw, through the conduit, and through the drinking straw to exit the container, the fluid router is configured such that a portion of the drinking straw that engages the first conduit end is adapted to be axially aligned with the thermal energy storage member engaged with the connector, the fluid router and second straw combining to allow the drinking straw to draw consumable beverage from proximate a bottom of the chamber while being linearly aligned with the thermal energy storage member.

17. The system of claim 16, further comprising a plurality of tabs depending from the base and adapted to extend into the container when the base is engaged with the container.

18. The system of claim 17, wherein the tabs further comprise a rib extending generally outwardly therefrom and adapted to abut an inner surface of the container.

19. The system of claim 18, wherein the plurality of tabs are configured to abut an inner surface of the container to facilitate the proper alignment of the fluid router while the fluid router is engaged with the container.

20. A system for use with a consumable beverage, comprising:

a container defining a chamber adapted to hold the consumable beverage, the container having an opening;

a lid adapted for engaging the container; a drinking straw located on the lid;

a thermal energy storage member located in the chamber and adapted to heat and/or cool the consumable beverage in the chamber;

a fluid router comprising:

a base adapted for placement over and/or in the opening of the container; a conduit disposed on the base and having first and second conduit ends, the first conduit end having a first opening adapted to face generally away from the container when the fluid router is engaged with the container, the second conduit end having a second opening adapted to face the chamber when the fluid router is engaged with the container;

a plurality of tabs depending from the base and adapted to extend into the container when the base is engaged with the container, wherein the tabs further comprise a rib extending generally outwardly therefrom and adapted to abut an inner surface of the container, the plurality of tabs being configured to abut an inner surface of the container to facilitate the proper alignment of the fluid router while the fluid router is engaged with the container; and a connector disposed on the base and adapted to engage the thermal energy storage member located in the chamber;

wherein the first conduit end is adapted to engage the drinking straw so that at least some of the consumable beverage can flow from the chamber, through the conduit, and through the drinking straw to exit the container.

21. The system of claim 20, further comprising a second straw engaged with the second conduit end and positioned within the chamber, the fluid router being configured such that a portion of the drinking straw that engages the first conduit end is adapted to be axially aligned with the thermal energy storage member engaged with the connector, the fluid router and second straw combining to allow the drinking straw to draw consumable beverage from proximate a bottom of the chamber while being linearly aligned with the thermal energy storage member.

22. The system of claim 21, wherein the lid is generally hemispherical and comprises a shield moveable between a first position, in which the drinking straw extends from the lid and is configured for drinking, and a second position, in which the straw is at least partially compressed and is contained within a cavity in the lid so as not to protrude from the lid.

23. A system for use with a consumable beverage, comprising:

a container defining a chamber adapted to hold the consumable beverage, the container having an opening;

a lid adapted for directly engaging the container;

a drinking straw located on the lid; and a fluid router detachable from the lid, the fluid router comprising:

a base adapted for placement over and/or in the opening of the container; and a conduit disposed on the base and having first and second conduit ends, the first conduit end having a first opening adapted to face generally away from the container when the fluid router is engaged with the container, the second conduit end having a second opening adapted to face the chamber when the fluid router is engaged with the container;

wherein the first conduit end is adapted to engage the drinking straw so that at least some of the consumable beverage can flow from the chamber, through the conduit, and through the drinking straw to exit the container.

24. The system of claim 23, wherein the drinking straw is continuously on the lid.

25. The system of claim 23, further comprising a connector disposed on the base of the fluid router and adapted to engage a thermal energy storage member located in the chamber.

26. The system of claim 25, further comprising a second straw engaged with the second conduit end and positioned within the chamber, wherein the fluid router is configured such that a portion of the drinking straw that engages the first conduit end is adapted to be axially aligned with the thermal energy storage member engaged with the connector, the fluid router and second straw combining to allow the drinking straw to draw consumable beverage from proximate a bottom of the chamber while being linearly aligned with the thermal energy storage member.

27. The system of claim 26, wherein the conduit is configured to extend through first and second generally ninety degree bends such that the drinking straw and the second straw define axes that are generally parallel.

28. A fluid router for use with a container defining a chamber adapted to hold a consumable beverage and having an opening and a lid adapted to engage the container, comprising:

a base adapted for placement in proximity to the opening of the container;

a conduit disposed on the base and having first and second conduit ends, the first conduit end having a first opening adapted to face generally away from the container when the fluid router is engaged with the container, the second conduit end having a second opening adapted to face the chamber when the fluid router is engaged with the container; and a connector disposed on the base and adapted to engage a thermal energy storage member located in the chamber;

wherein the fluid router is detachable from the lid.

29. The fluid router of claim 28, wherein the first conduit end is adapted to engage a drinking straw located in the lid.

30. The fluid router of claim 29, further comprising a second straw engaged with the second conduit end and positioned within the chamber.

31. The fluid router of claim 30, wherein the fluid router is configured such that a portion of the drinking straw that engages the first conduit end is adapted to be axially aligned with the thermal energy storage member engaged with the connector, the fluid router and the second straw combining to allow the drinking straw to draw the consumable beverage from the chamber while being linearly aligned with the thermal energy storage member.

* * * * *